United States Patent [19]

Morane

[11] 4,118,874

[45] Oct. 10, 1978

[54] HAIR DRYER, ESPECIALLY FOR LONG HAIR

[75] Inventor: Bruno Morane, Paris, France

[73] Assignee: L'Oreal, Paris, France

[21] Appl. No.: 677,403

[22] Filed: Apr. 15, 1976

[30] Foreign Application Priority Data

Apr. 17, 1975 [FR] France ..... 75 11986

[51] Int. Cl.[2] ..... A45D 20/24

[52] U.S. Cl. ..... 34/101; 34/100; 34/99

[58] Field of Search ..... 34/3, 96–101, 34/239

[56] References Cited

U.S. PATENT DOCUMENTS

| | | | |
|---|---|---|---|
| 1,514,495 | 11/1924 | Wirth | 34/101 |
| 2,012,473 | 8/1935 | McElroy et al. | 34/100 |
| 3,782,002 | 1/1974 | Morane | 34/99 |
| 3,816,940 | 6/1974 | Cournoyer | 34/99 |

FOREIGN PATENT DOCUMENTS

| | | | |
|---|---|---|---|
| 623,383 | 12/1935 | Fed. Rep. of Germany | 34/99 |
| 22,463 of | 1902 | United Kingdom | 34/101 |
| 413,233 | 7/1934 | United Kingdom | 34/100 |

*Primary Examiner*—Kenneth W. Sprague
*Assistant Examiner*—James C. Yeung
*Attorney, Agent, or Firm*—Brisebois & Kruger

[57] ABSTRACT

Improved hair dryer has inner and outer ducts connected at one end to a centrifugal fan and at the other end to a hood. The fan sucks air through the inner duct and blows it toward said hood through the outer duct. A grille for supporting long hair is positioned in the inner duct so that air drawn toward the fan is drawn through any long hair on said grille.

9 Claims, 2 Drawing Figures

HAIR DRYER, ESPECIALLY FOR LONG HAIR

SUMMARY OF THE INVENTION

This invention relates to an improvement on the device described in U.S. Pat. No. 3,782,002.

It is well known that after treatments which involve the moistening of hair a heating dryer is ordinarily used to dry the hair sufficiently to permit it to be arranged.

The dryers heretofore used have comprised a blower which directs a certain flow of air over a heating electrical resistance, the flow of hot air being projected against the damp hair of the user, which is positioned beneath a hood. The time spent by a user beneath such a dryer is always relatively unpleasant because the hot air carrying the moisture resulting from its passage over the damp hair flows around the head of the user and produces an unpleasant sensation. It is difficult to envisage any method of reducing the time spent beneath the drying hood because it is scarcely possible to increase the temperature due to the discomfort which would result for the user. The drying of long hair requires that a particularly long time be spent beneath the hood and thus entails the maximum discomfort for the user.

In U.S. Pat. No. 3,782,002, an improved hair dryer has been described which is particularly adapted for use on long hair. This dryer comprises a blower for driving air in the direction of the hair to be dried characterized by the fact that a duct is provided at the outlet of the blower and the hair to be dried is positioned at the free end of said duct.

It has been found that, with the device described in said French patent, the long, damp hair has a tendency, despite the presence of a current of air inside it, to position itself near the lowermost part of the duct so that while it dries more rapidly than in the devices previously known, it still took quite a while to dry. It is the object of the present invention to describe an improved dryer of the type disclosed in said French patent which makes it possible to avoid this disadvantage. For this purpose, in accordance with the invention, the layer of long hair to be dried is positioned within an inner duct located inside the main duct for air from said blower, said inner duct leading air to the suction zone of the blower and being downwardly inclined when positioned on the head of the user.

It is therefore an object of the present invention to provide as a new article of manufacture an improved hair dryer which is particularly useful in drying long hair, which dryer comprises a device for blowing air in the direction of the hair to be dried, an outer duct being mounted at the outlet of the blower, and the hair to be dried being located at the free end of said duct. The dryer also comprises an inner duct having an open end adjacent the hair to be dried, and the other end of which leads to the suction zone of the blower. The dryer is characterized by the fact that the inner duct is positioned inside the outer duct and the end of the outer duct adjacent the head of the user is closed by a perforated hood having a plurality of orifices.

In a preferred embodiment of the invention, the blower is positioned at a level lower than that occupied by the head of the user at the end of said ducts. Heating resistances are positioned in the annular space between the two ducts. At least one heating resistance is positioned in the inner duct near the end of said inner duct which is closest to the head of the user. The inner duct encloses a grille obliquely positioned across the duct.

The grille extends from one end of said inner duct to the other. In the zone just below the end of the inner duct adjacent the hood there is an elongated nozzle which extends over a distance approximating the width of the inner duct. Each orifice formed in the hood which leads to the annular zone between the inner and outer ducts is provided with a blowing nozzle directing a jet of air in the direction of the head of the user. The blower is a centrifugal fan comprising at least one blade driven in rotation about its axis by a motor, the suction zone of said fan, which is located near its axis, being positioned in alignment with the lower end of the inner duct, while the blowing zone, situated in the vicinity of the ends of its blades, is in alignment with the cylindrical ring between the two ducts. The motor of the blower is an electrical motor positioned below the blades which comprises suction vanes on the side of the motor drawing air from an orifice positioned below the motor.

To utilize the device according to the invention to dry long hair, the long hair is positioned inside the duct with the head of the user located inside the hood. The long hair then rests on the grille extending through the duct and the layer constituted by the hair is traversed by the current of air blown by the blower.

It should be noted that the air sucked into the inner duct comes in large part from the air blown through the outer duct and the blowing nozzles which pass through the hood. This withdrawal of hot air has two essential advantages. On the one hand it makes it possible to substantially reduce the loss of hot air between the edges of the hood and the periphery of the head of the user, which contributes greatly to the comfort experienced by the user of the hood. On the other hand, it makes it possible to recover the heat contained in the flow of hot air, with the air thus circulating in a closed circuit defined by the outer duct, the hood, the inner duct, and the blower. The losses of hot air which nevertheless occur in a limited manner between the edge of the hood and the periphery of the head of the user are compensated for by outer air sucked on the one hand, around the head of the user at spots which are under sub-atmospheric pressure, and on the other hand, through the orifice positioned beneath the motor driving the blower. This additional air sweeps the space occupied by the fan motor, thus cooling the motor, and is introduced into the circuit after preheating due to the cooling of said motor.

The fact that a heating resistance is positioned at the entrance of the suction duct makes it possible to compensate for the heat losses undergone by the air when projected over the hair to be dried inside the hood of the dryer. It is thus possible to use a reheated air for drying the long hair positioned in the duct in a layer which lies on the grille positioned through said duct. It is preferred to position the heating resistances for the blown air in the annular zone between the passage and the duct near the drying hood so as to decrease the heating delay during starting. Finally, the location of an elongated blowing nozzle beneath the opening in the hood at the end of the inner duct makes it possible to insure with great efficacity the drying of the base of the long hair which is positioned in said inner duct.

With the device according to the invention it has been found that it is possible to dry long, loose hair in a period of between 15 and 20 minutes and long hair on rollers in a period of between 20 and 30 minutes. Moreover, because the flow of air in the dryer according to the invention is perfectly channeled, whereas it is turbulent in dryers of the conventional type, it has been found that the hair, after drying, is less electrified. This considerable decrease in turbulence in the hood renders it unnecessary to provide a snood for holding the moist hair which is to be dried in place. The fact that this snood can be eliminated is a supplemental factor decreasing the required drying time.

Finally, the considerable decrease in turbulence in the flow of air in the hood results in a decrease in noise and consequently greater comfort for the user.

In order that the invention may be better understood one embodiment thereof will now be described, purely by way of illustration and example, with reference to the accompanying drawings, on which:

Figure 2:
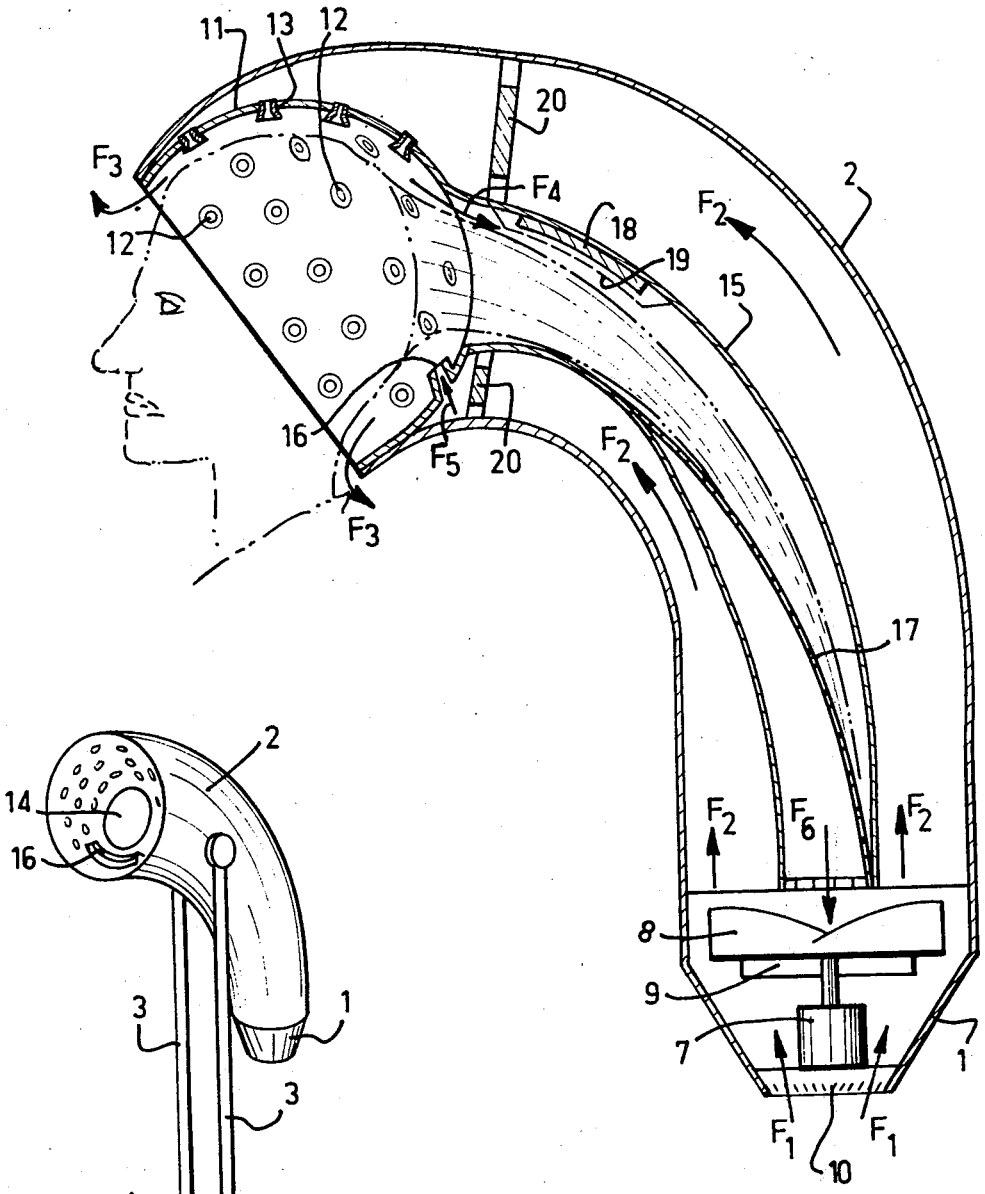
FIG. 2 is an axial sectional view taken through the dryer of FIG. 1.
Figure 1:
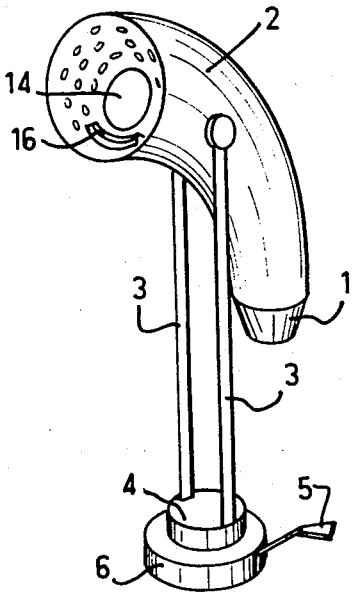
FIG. 1 is a perspective view of a dryer according to the invention.

Referring now to the drawings, it will be seen that reference numeral 1 indicates the housing which encloses the blower of the dryer according to the invention and 2 indicates the duct which is connected to the outlet of said blower. Duct 2 is supported by vertical supporting columns 3, connected thereto by pivot means which permit the duct 2 to be swung about a horizontal axis. The supporting columns 3 are fixed to a base 4 adapted to be adjusted in height by means of the adjusting handle 5 relative to the pedestal 6.

The housing 1 encloses an electric motor 7 having a vertical axis which drives the blades 8 of the centrifugal fan. Below the principal blades the fan carries suction blades 9 which assure an aspiration of air through the bottom 10 of the casing 1, which bottom has a perforated wall permitting the passage of air in the direction indicated by the arrows F1.

FIG. 2 shows the assembly fixed to the duct 2, with the supporting column and pedestal of the dryer omitted.

The duct 2 has a circular section and is connected at its lower end to the upper end of the casing 1. At its other end the duct 2 is blocked by a hood 11 perforated by orifices 12 which are regularly distributed over the entire surface of the hood 11. In each orifice 12 is positioned a nozzle 13 of plastic material adapted to form a jet of air directed perpendicularly to the head of the user. The air jet formed in this manner is intended to penetrate into the mass of the hair to increase the efficacity of drying. The part of the hood 11 which fits over the back of the head of the user has an opening 14 leading to an inner duct 15, the section of which is substantially equal to one-fourth that of the outer duct 2. The section of the inner duct 15 is circular and the median line of the inner duct 15 has substantially the same curved form as the median line of the outer duct 2. The lower end of the inner duct 15 opens in alignment with the central zone of the blades 8 of the fan. Just below the opening 14 in the hood 11 is a blowing nozzle 16 which is substantially in alignment with the nape of the neck of the user when her head is inside the hood 11.

Inside the inner duct 15, and transversely positioned across said duct, is a grille 17 which extends from one end to the other of the duct. The grille 17 may consist, for example, of a sheet of expanded metal. The upper end of the inner duct 15, near the opening 14, contains a heating resistance 18 from which the hair is protected by a protective grille 19. In the annular space between the inner duct 15 and the outer duct 2 near the hood 11 are heat resistances 20 arranged in a ring.

When the user, shown in broken lines on the drawing, places her head in position in the hood 11 of the dryer, the long hairs are located, when loose, inside the inner duct 15 and constitute a layer resting on the grille 17. When the dryer is operating the fan 8 drives air in the direction of the arrows F2 into the annular space between the outer duct 2 and the inner duct 15. This air is heated by the resistances 20 which are thermostatically controlled so as to produce a constant temperature of air at the inlet of the hood 11. The hot air penetrates into the nozzles 13 and is ejected in jets directed perpendicularly to the head of the user, these jets penetrating the hair and assuring an efficacious drying. The hot air blown into the hood 11 may either escape in the direction of the arrows F3, between the head of the user and the edge of the hood, or may be sucked, as indicated by the arrow F4, into the duct 15. The quantity of air which escapes in the direction indicated by the arrows F3 is much less than the quantity of air aspirated as indicated by the arrow F4. The same is true of the air blown through the nozzle 16 as indicated by the arrow F5. This air dries the roots of the long hair positioned in the inner duct 15. The air sucked into the inner duct 15 is heated by passing over the resistance 18, which compensates for the loss of heat which it underwent while partially drying the hair inside the hood 11, so that the air sucked into the inner duct 15 regains a high capacity to dry before passing over the long hair to be dried. The hair which passes through the duct 15 is sucked into the central zone of the fan 8 in the direction indicated by the arrow F6 and must therefore pass through the layer of long hair positioned on the grille 17 which results in rapid drying of that long hair.

As has already been indicated, the use of the dryer according to the invention is relatively pleasant, on the one hand, because of the decrease in turbulence inside the hood 11 which makes it unnecessary to use a snood to hold the hair in place, and, on the other hand, because of the decrease in the outflow of hot air toward the face of the user which results from suction into the inner duct 15. The fact that the resistances 20 are positioned near the hood 11 makes is possible to insure rapid heating of the apparatus. The electrical consumption for such a dryer is less because of the recovery of hot air through the inner duct 15 and the circulation in a closed circuit of the greater part of the flow of drying air, which assures an economic recovery of heat. Finally the turbulence inside the hood 11 is decreased and the dried hair is less electric.

It will of course be appreciated that the embodiment which has just been described has been given purely by way of illustration and example and may be modified as to detail without thereby departing from the basic principles of the invention.

What is claimed is:

1. In an improved hair dryer especially adapted to dry long hair, which dryer comprises an elongated first duct, a fan at one end of said duct for blowing air through said duct, said fan having a suction zone, and an elongated second duct terminating at one end in alignment with the suction zone of said fan, and at its other end near the other end of said first duct, the improvement according to which said second duct is positioned inside said first duct, means closing the end of said first duct remote from said fan and comprising a hood perforated by a plurality of orifices, the end of said second duct remote from said fan opening into said hood, said second duct being of a length sufficient and communicating with said hood through an opening large enough to accommodate fully extended long hair of the user introduced into said second duct, while said dryer is in place on the head of said user, grille means within said second duct comprising a grille extending the length of and obliquely across said second duct for supporting said fully extended long hair in said second duct, said fan comprising means for flowing drying air through said second duct and grille only in a direction toward said fan, means for supporting said dryer with said fan below said hood during use of the dryer, and resistance heating means in said second duct near said hood for heating air drawn from said hood into said second duct.

2. Dryer as claimed in claim 1 in which heating resistances are positioned in an annular space between said ducts.

3. Dryer as claimed in claim 1 in which there is an elongated blowing nozzle extending over a length approximating the width of the second duct just below the point at which said inner duct opens into said hood.

4. Dryer as claimed in claim 1 in which each of said orifices in said hood is provided with a blowing nozzle channeling air in the direction of the head of the user.

5. Dryer as claimed in claim 1 in which the fan is a centrifugal fan comprising at least one vane rotatably driven about its axis by a motor, said fan having said suction zone near its axis in alignment with said one end of the duct and a blowing zone situated near the ends of said vane in alignment with the lower part of the annular space between the first and second ducts.

6. Dryer as claimed in claim 1 in which said fan has vanes and is driven by an electric motor positioned beneath the vanes, and said vanes include, on the side adjacent the motor, suction blades drawing air from an orifice positioned below the motor.

7. A hair dryer according to claim 1 wherein, said second duct curves downwardly toward the fan between the hood and the fan.

8. A hair dryer according to claim 7 wherein, said first duct curves smoothly downwardly toward the fan.

9. A hair dryer according to claim 7 wherein, said grille curves within the second duct.

* * * * *